US006805465B2

(12) United States Patent
Chen

(10) Patent No.: US 6,805,465 B2
(45) Date of Patent: Oct. 19, 2004

(54) DISPLAY SEAT FOR GLASS AND CRYSTAL ARTICLES OF DISPLAY

(76) Inventor: Su-Mei Chen, P.O. Box 24-108, Taipei (TW)

( * ) Notice: Subject to any disclaimer, the term of this patent is extended or adjusted under 35 U.S.C. 154(b) by 89 days.

(21) Appl. No.: 10/074,433

(22) Filed: Feb. 13, 2002

(65) Prior Publication Data

US 2003/0151911 A1 Aug. 14, 2003

(51) Int. Cl.[7] ..... F21V 5/00

(52) U.S. Cl. ..... 362/246; 362/125; 362/800; 362/101

(58) Field of Search ..... 362/101, 131, 362/96, 26, 27, 29, 30, 125, 134, 240, 253, 330, 364, 800, 246, 132; 40/406, 407, 572, 431

(56) References Cited

U.S. PATENT DOCUMENTS 3,808,084 A * 4/1974 Doty ..... 248/346.11
5,249,104 A * 9/1993 Mizobe ..... 362/31
5,575,554 A * 11/1996 Guritz ..... 362/103
5,865,516 A * 2/1999 Woy ..... 312/125
6,443,593 B1 * 9/2002 Lauschner ..... 362/239
6,578,981 B2 * 6/2003 Jackson et al. ..... 362/104

FOREIGN PATENT DOCUMENTS

JP 05245031 * 9/1993
JP 405253044 A * 10/1993
JP 02000201793 A * 5/2000
JP 2001120416 * 5/2001

* cited by examiner

*Primary Examiner*—Thomas M. Sember
*Assistant Examiner*—Hargobind S. Sawhney
(74) *Attorney, Agent, or Firm*—Troxell Law Office PLLC

(57) ABSTRACT

A display seat for displaying glass and crystal articles of display includes a seat body which is a plate or a layered plate formed from a transparent plastic material or glass. The seat body has a bottom portion formed with a recess. A circuit substrate board having a plurality of light emitting diodes is insertably disposed in the recess. The display seat can be connected to an external power source or a battery source to establish electrical connection for activating the light emitting diodes. Shallow grooves can be formed in a top portion of the seat body for placement of round or curved articles of display. Beams of light emitting from the light emitting diodes penetrate through the plastic or glass seat body toward the articles of display on the seat body.

2 Claims, 3 Drawing Sheets

DISPLAY SEAT FOR GLASS AND CRYSTAL ARTICLES OF DISPLAY

BACKGROUND OF THE INVENTION (a) Field of the Invention

The present invention relates to a display seat for glass and crystal articles of display, more particularly to a display seat which includes a seat body made of a transparent plastic material or glass and formed with a recess for receiving therein a circuit substrate board that has a plurality of light emitting diodes disposed thereon. The display seat is also formed with shallow grooves adapted for placement of round or curved articles of display therein. Beams of light emitted from the light emitting diodes pass through the seat body onto the articles of display placed on the display seat, thereby eliminating the trouble of mounting lighting fixtures to light up the articles of display.

(b) Description of the Prior Art

In exhibitions or shops that display arts of craft, such as glass and crystal articles, in order to highlight the beauty or contour of the articles of display, lighting fixtures are mounted to radiate light on the articles of display. However, the lighting fixtures are relatively bulky, inconvenient to install or disassemble, and entail troublesome work of wiring. Besides, they are comparatively costly and inconvenient to carry to exhibition sites for quick installation.

SUMMARY OF THE INVENTION

Therefore, the primary object of the present invention is to provide a display seat for glass and crystal articles of display, which includes a seat body that is a plate or a layered plate formed from a transparent plastic material or glass. The seat body has a bottom portion formed with a recess. A circuit substrate board having a plurality of light emitting diodes is insertably disposed in the recess. The display seat can be connected to an external power source or a battery source to establish electrical connection for activating the light emitting diodes. Shallow grooves can be formed in a top portion of the seat body for placement of round or curved articles of display. Beams of light emitting from the light emitting diodes penetrate through the plastic or glass seat body toward the articles of display on the seat body. There is no need to provide additional lighting.

Another object of the present invention is to provide a display seat for glass and crystal articles of display, in which a light source is directly mounted in a seat body and is connectable to an external power source so that the display seat can be carried conveniently to an exhibition site or the like for quick installation.

A further object of the present invention is to provide a display seat for glass and crystal articles of display, which can be adopted as a shelf of a display cabinet or rack, and which can be used to provide a light source that radiates upwardly or downwardly, which can be connected to a direct current power source, and which can serve as a night light or a lighting device.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 3:
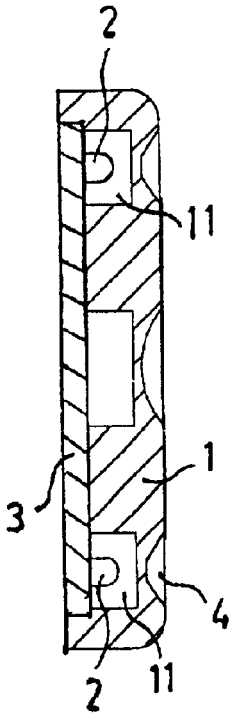
FIG. 3 is a sectional view of the first preferred embodiment of the invention.
Figure 1:
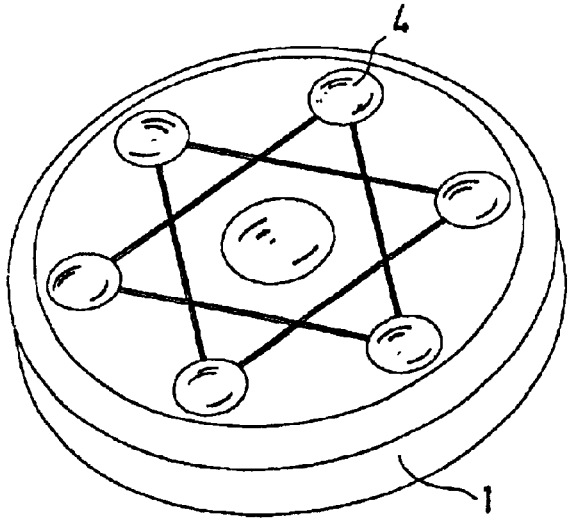
FIG. 1 is a perspective view of the first preferred embodiment of the invention.
Figure 2:
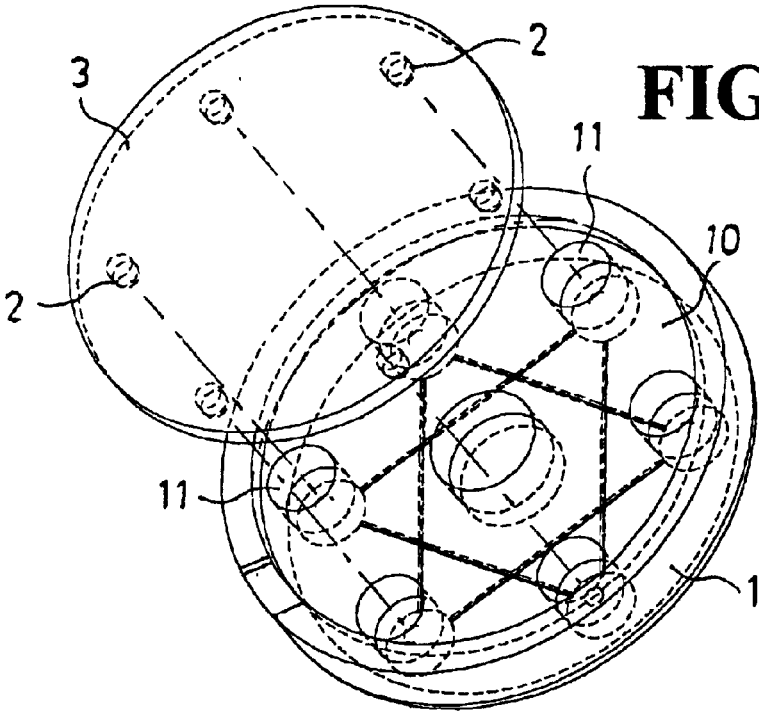
FIG. 2 is an exploded perspective view of the first preferred embodiment of the invention.
Figure 5:
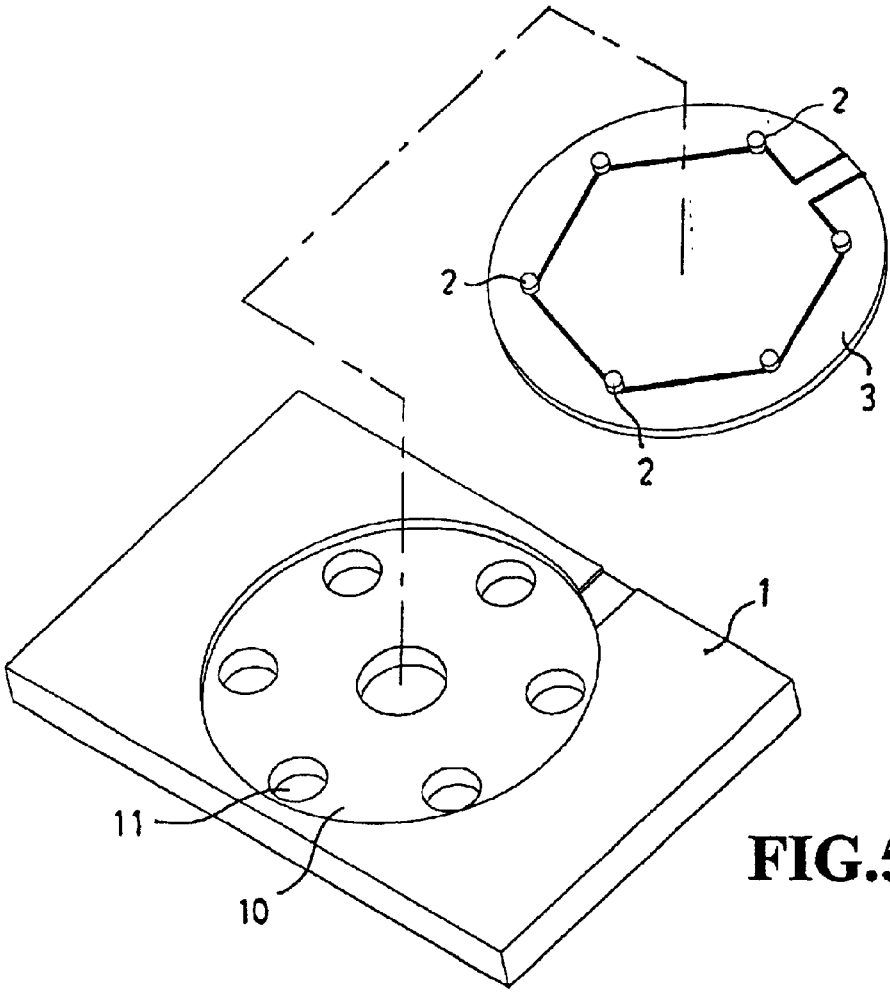
FIG. 5 is an exploded perspective view of the second preferred embodiment of the invention.
Figure 4:
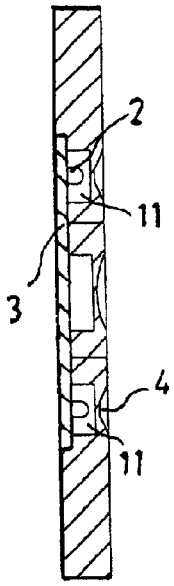
FIG. 4 is a perspective view of the second preferred embodiment of the invention.
Figure 6:
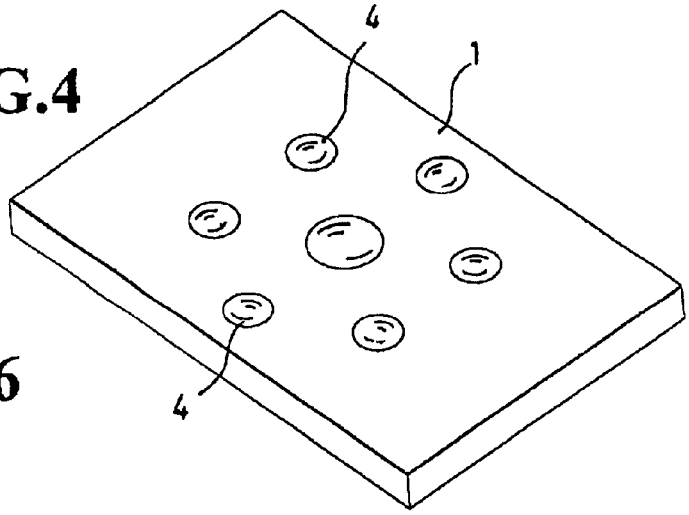
FIG. 6 is a sectional view of the second preferred embodiment of the invention.
Figure 7:
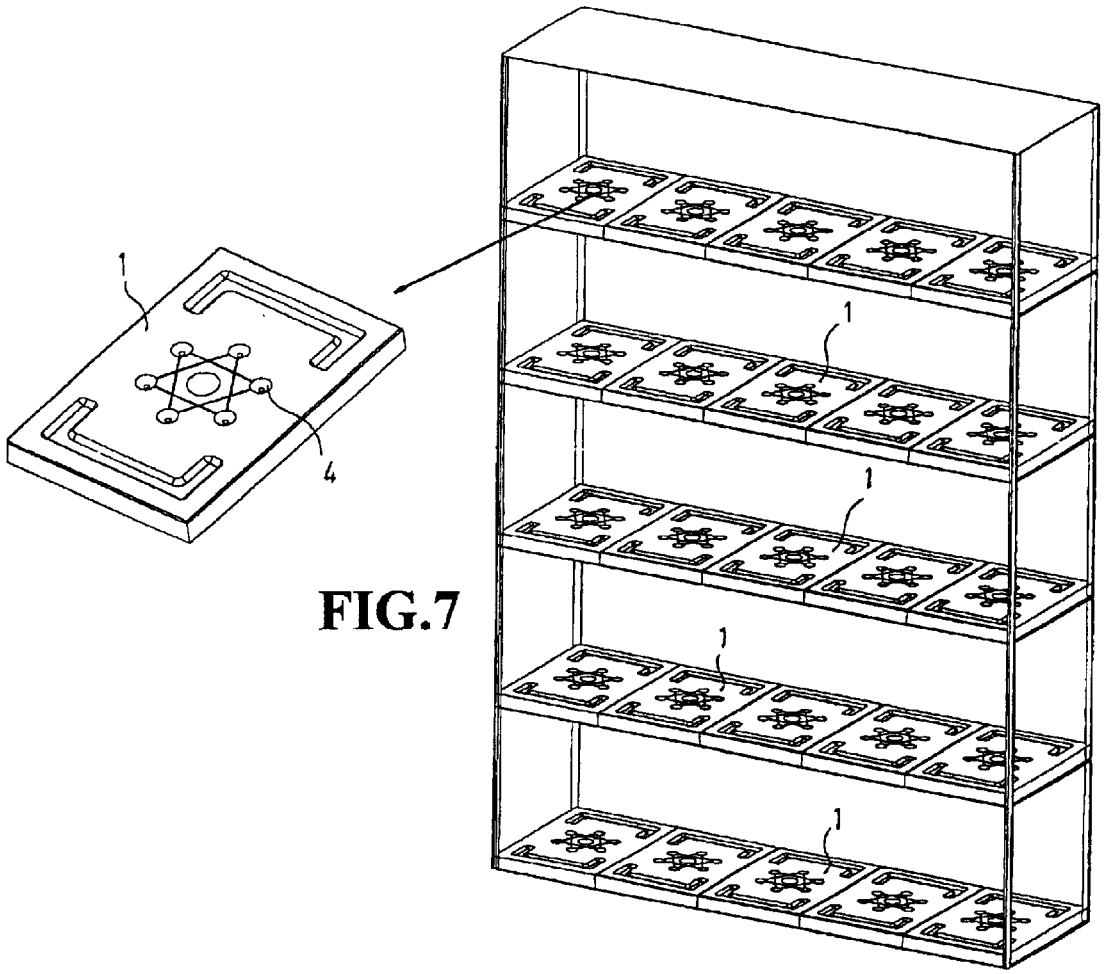
FIG. 7 is a perspective view of the invention when adapted for use in a display cabinet.

With reference to the drawings, the present invention includes a seat body 1, light emitting diodes 2, and a circuit substrate board 3. The seat body 1 is a plate or layered plate formed from a transparent plastic material, such as acrylic, or glass, and has a bottom portion formed with a recess 10 for receiving the circuit substrate board 3 inserted therein. The circuit substrate board 3 has a suitable number of light emitting diodes 2 disposed thereon. The recess 10 of the seat body 1 is further formed with cavities 11 for accommodating the light emitting diodes 2 at corresponding positions. The circuit substrate board 3 is disposed to connect to an external power source or a battery unit so as to establish electrical connection for supplying electric power to the light emitting diodes 2. If necessary, a top portion of the seat body 1 can be formed with shallow grooves 4 for receiving round or curved articles of display. In addition, the circuit substrate board 3 has a connecting circuit provided with an electronic control to control movement and flashing of the lights so as to provide a multifarious visual effect. The light emitting diodes 2 can also be mounted below the circuit substrate board 3 to emit light downward and toward a shelf below.

In actual use, the present invention is placed on a shelf of a display cabinet or display rack at a suitable position. Then, articles of display are put on the seat body 1. Round and curved articles of display can be arranged in the shallow grooves 4 so as to be prevented from slipping. The circuit substrate board 3 is subsequently connected to the power source or the battery unit so as to turn on the light emitting diodes 2. The beams of light emitted from the light emitting diodes 2 penetrate through the seat body 1 toward the articles of display on the seat body 1 so as to light up the articles of display. The light emitting diodes 2 emit soft light, consumes a small amount of electric power to permit prolonged use, would not cause damage to the articles of display, and can be used in conjunction with wooden seats. In addition, as they can be connected to the power source conveniently, and have an integral structure, the size or weight of the seat body 1 will not be increased. As such, the present invention is convenient to carry and used for display purposes. Furthermore, the present invention is inexpensive to fabricate, and can serve as a shelf of a display cabinet. The present invention can also serve as a night light or a lighting device.

Although the present invention has been illustrated and described with reference to the preferred embodiment thereof, it should be understood that it is in no way limited to the details of such embodiments but is capable of numerous modifications within the scope of the appended claims.

What is claimed is:

1. A display seat for glass and crystal articles of display, comprising:

a) a transparent seat body having a recess on a bottom thereof, and a plurality of shallow grooves formed on a top portion thereof and receiving the articles of display;

b) a circuit substrate board inserted into the recess of the seat body; and c) a plurality of light emitting diodes connected to the circuit substrate board, whereby the circuit substrate board is connected to a power source to activate the plurality of light emitting diodes, each of the plurality of light emitting diodes coaxially aligning with respective one of the shallow grooves with one of the plurality of shallow grooves to illuminate the articles of display, wherein said circuit substrate board has a connecting circuit provided with an electronic control for controlling apparent movement of lights produced by their sequential actuation, and flashing of the lights generated by the light emitting diodes.

2. The display seat for glass and crystal articles of display as claimed in claim 1, wherein said light emitting diodes are mounted below said circuit substrate board to generate light downwardly and toward a shelf therebelow.

* * * * *